US006156264A

United States Patent [19]

Johnston et al.

[11] Patent Number: 6,156,264

[45] Date of Patent: Dec. 5, 2000

[54] ELECTROMAGNETIC COMPACTING OF POWDER METAL FOR IGNITION CORE APPLICATION

[75] Inventors: Ralph Herbert Johnston, Anderson; David Allen Score, Shirley; David Earl Gay, Pendleton; Albert Anthony Skinner, Anderson, all of Ind.

[73] Assignee: Delphi Technologies, Inc., Troy, Mich.

[21] Appl. No.: 09/413,678

[22] Filed: Oct. 6, 1999

[51] Int. Cl.[7] ..... B22F 1/02

[52] U.S. Cl. ..... 419/64; 419/65; 419/66

[58] Field of Search ..... 419/64, 65, 66

[56] References Cited

U.S. PATENT DOCUMENTS 5,002,727 3/1991 Okimoto et al. ..... 419/10
5,211,896 5/1993 Ward et al. ..... 264/126
5,250,255 10/1993 Sagawa et al. ..... 419/39
5,405,574 4/1995 Chelluri et al. ..... 419/47
5,472,661 12/1995 Gay ..... 419/36
5,629,092 5/1997 Gay et al. ..... 428/407

*Primary Examiner*—Daniel J. Jenkins
*Attorney, Agent, or Firm*—Margaret A. Dobrowitsky

[57] ABSTRACT

Disclosed is a process for producing an AC cylindrical electromagnetic ignition coil core (28) comprising:

filling a cylindrical holding container (20) with powdered metal;

placing the filled container into an electromagnetic field and compacting, in the radial direction, the powder in the container by subjecting the powder to the electromagnetic field; and recovering the compacted ignition coil core (28).

14 Claims, 2 Drawing Sheets

ELECTROMAGNETIC COMPACTING OF POWDER METAL FOR IGNITION CORE APPLICATION

TECHNICAL FIELD

The field of the invention is the compacting electromagnetic products of powdered metal, which products are utilized as cores for electromagnetic devices such as transformers, inductors, motors, generators, relays, and ignition coils.

BACKGROUND OF THE INVENTION

Ignition coil assemblies used in the automotive industry have in the past been placed where there is enough space to contain the size and shape of the coil assembly. Long wires are used to connect to spark plugs. This creates losses in the wires and unnecessary size and weight under the hood.

The ignition coil assembly is directly applied to the spark plug or attached very near to the spark plug. This patent describes an improved method for producing the core of such coil assembly.

This present invention relates to an effective cost efficient process to produce the core in an ignition coil assembly that is fastened directly onto the spark plug or mounted very near the plug of an internal combustion engine.

Typically, the ignition cores have been produced with thin lamination or powdered iron with a thin layer of polymer coating over each particle of iron. (See U.S. Pat. No. 5,211,896).

The powdered iron particles with thin layers of polymer and/or the thin laminations are used to carry magnetic flux. The polymer and/or resin coatings over each particle are used to reduce eddy current losses, as are the sheets of lamination. These losses occur in AC and pulse DC applications.

When attaching the ignition coil assembly directly onto the spark plug or mounting near the plug, a cylindrical design is the most space efficient. Reduction in size is a very important design feature for under hood applications in future automobiles.

Flat laminations do not lend themselves to circular design, and powdered iron with microencapsulated polymers uniaxially compacted typically do not have as high a flux carrying capacity due to lower density (6.90–7.4 gm/cc) or commonly called percent of fill (88–94%).

Previous attempts to achieve 99% theoretical density on powdered metal have resulted in high core losses due to breakdown of coated layer. Two examples of these attempts are pneumatic forging and the Ceracon process (trademark of Ceracon, Inc.).

The trend in the automotive ignition industry is for a smaller coil assembly which can be placed closer to the spark plug or integrated into the spark plug design. The core, as well as the coil assembly, needs to be smaller and also more efficient.

Currently, most cores for AC electromagnetic ignition application utilize either a laminated core or a composite iron core pressed by uniaxial compaction. The laminated cores have fairly good magnetic properties but are expensive to produce and have a limited application because of restricted design flexibility and dimensional tolerance capabilities. The sharp edges produced during blanking may cause primary wire grounds on cylindrical designs. The uniaxial composite iron cores also have fairly good magnetic properties, but are limited to a medium density because of the lack of compressibility of the composite iron powder and uniaxial molding process. If the composite iron core is compacted in the horizontal direction, burrs at the parting lines which run along with length of the part, cause reduced dimensional accuracy and winding grounds. This often requires a secondary grinding process to overcome these problems, which adds costs to the process.

Other patents of interest include U.S. Pat. No. 5,405,574; U.S. Pat No. 5,472,661 and U.S. Pat. No. 5,629,092.

SUMMARY OF THE INVENTION

Described is a process for producing a cylindrical electromagnetic core comprising: filling a cylindrical holding container with powdered metal; placing the filled container into an electromagnetic field and compacting, in the radial direction, the powder in the container by subjecting the powder to a electromagnetic field; and recovering the compacted part.

Also described is an improved electromagnetic core comprising a compacted powdered metal part, which has been compacted in the radial direction by being subjected to an electromagnetic field wherein the part has at least 90% of theoretical density of the metal.

DESCRIPTION OF PREFERRED EMBODIMENTS

According to the present invention, there is provided a mass of ferromagnetic particles which are readily processable into physically strong magnetic cores capable of surviving thermally and chemically hostile environments. It is known that soft magnetic cores are required for electromagnetic devices. The term "iron" as used herein applies not only to substantially pure iron, but also to the well known alloys that are used for such purposes, such as copper, nickel, zinc, cobalt, silicon and manganese, including, for example Fe—Si, Fe—Al, Fe—Si—Al, Fe—Ni, Fe—Co, and the like. Alloyed iron particles provide higher magnetic permeability and lower total core losses (that is eddy current hysteresis and anolomous losses) and results in devices having higher efficiencies than devices using pure iron cores.

In the present application, particles of iron or iron alloys are utilized. The particle sizes range from about 5 to 400 micrometers.

Figure 1:
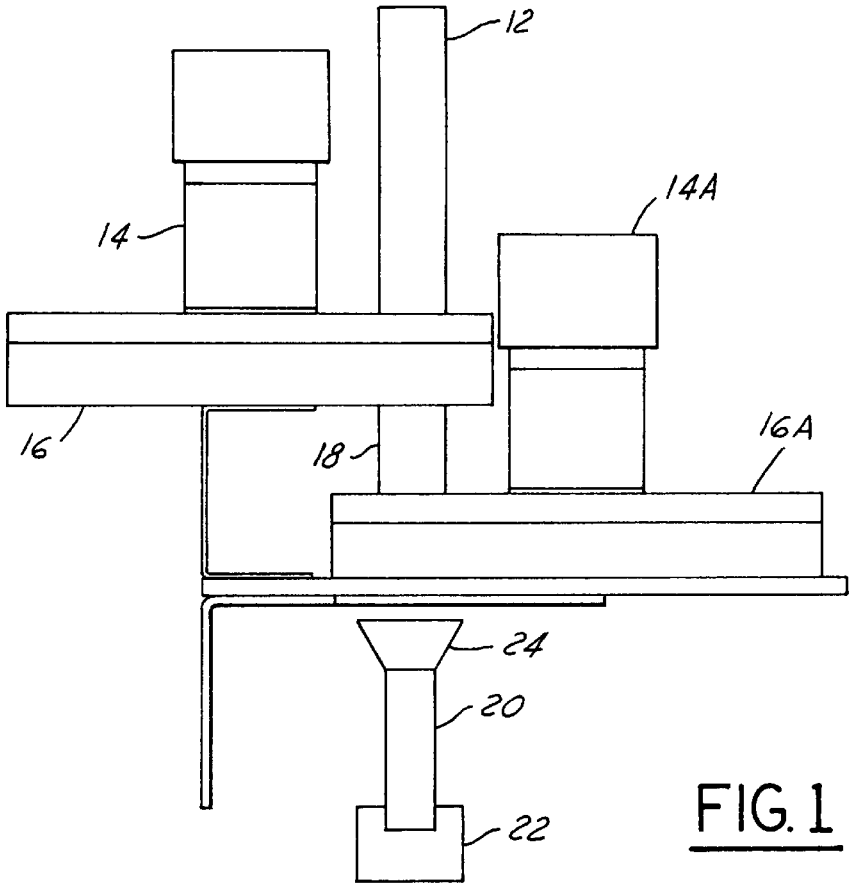
FIG. 1 is a schematic drawing of the process of the present invention.
Figure 2:
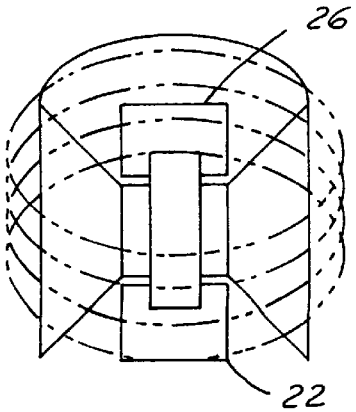
FIG. 2 is a schematic representation of subjecting the filled container to an electromagnetic field.

As shown in the attached drawings, the particles are introduced into a Tube 12 with powder from a supply hopper (not shown). Rotary electric solenoids 14 and 14A are used to rotate rotary shut-off valves 16 and 16A. This permits the charge of particles to flow from the top of the tube 12 to the bottom 18 and into a tube 20 which is inserted into a stop portion 22 through circular inlet 24. After the tube is filed, a cap 26 is placed on top of the tube 20, thereby initially compacting the powder metal within the tube. The assembly of tube 20 stop 22 and cap 26 are inserted into an electromagnetic field (FIG. 2). There a high power pulse from capacitors is released into a copper wire that generates a large electromagnetic field around the powdered iron and the tube holding the iron. The tube that is utilized is a conductor material, such as a metallic tube, preferably a copper tube.

The electromagnetic field ranges from about 1–200 Oersted, preferably 50–200 Oersted. The length of time that the tube is subjected to the electromagnetic field is generally 1 second or less, preferably less than 80 microseconds. Alternatively the electrical energy to be dissipated is from 50–150 kjoules.

The magnetic field will generate eddy currents in the tube which generates a counter magnetic field; thus creating forces on the particles which results in a uniform high density core. The conductive tube acts as a pressure transmitting medium to the powder.

The compaction that occurs is in a radial direction so that the tube holding the powdered metal and the powdered metal itself is compacted to size, thus increasing the density to within at least 96%, preferably 99% of theoretical density of the material, if required. Also, density variation within the part is very minimal, less than 0.03 gram per cubic centimeter variation in density. The high density and uniform density aids in producing an electromagnetic core of consistent performance.

When the compacted powder core is extracted from the conductive tube a very smooth surface is remaining. Because of the resistivity of the material and the smooth surface, the primary winding can then be wound directly onto the core surface.

Figure 3:
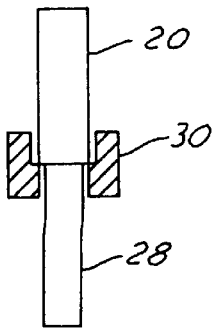
FIG. 3 is a schematic representation of the circular core produced by the process described herein.

FIG. 3 shows that the circular core 28 is separated from the copper tube 20 by passing it out of the copper tube. Usually the core can be pushed out from the copper tube by a mechanical means whereby the tube is held in place by member 30 and a physical force exerted at the top of the tube to force out the compacted iron core.

While the iron particles do not necessarily require aids for maintaining its size and compaction, it is desirable that the particles be encapsulated in a polymeric material.

The particles each comprise an iron core encapsulated in a continuous shell of an amorphous thermoplastic, thermoset and/or inorganic materials. The thermoplastic shell is selected from the group consisting of a polyetherimide, polyethersulfone and polyamideimide having a heat deflection greater than about 200° C. (ASTM D-648). The thermoplastics will preferably have a melt viscosity (i.e., at 360° C.) less than about 5500 poises (i.e., at a shear rate of 1000 reciprocal seconds) and most preferably less than about 2200 poises. Polyamideimide is also reactive at its melting temperature so that it flows well below its melt temperature but while in the melt state slowly reacts and begins to lose its flowability. Hence, these polymers have excellent flow characteristics and distribute well throughout the tube during compaction without separating from the iron particles. Suitable polyethersulfones have molecular weights of about 15,000, a melting temperature of about 299° C. and a softening temperature somewhat below 299° C. Suitable polyetherimides have molecular weights between about 22,000 and 35,000, a melting temperature of about 252° C. and a softening temperature somewhat below 252° C. Suitable polyamnideimides will have a molecular weight of about 4,000, a melting temperature of about 316° C. and a softening temperature somewhat below 316° C. Suitable polyethersulfones are materials sold commercially as VICTREX™ in grades 3600P, 4100P and 4800P by the ICI Americas Corporation. Suitable polyetherimides are available commercially from the General Electric Company under the name ULTEM in various grades including ULTEM™ 1000, 1010, 1020, 1030 AND 1040. Suitable polyamideimides are available commercially from the AMOCO Corporation under the trade name "TORLON" (e.g., grade 4000 T).

The thermoplastic or thermoset shell is preferably deposited onto the surface of each particle from a spray of the thermoplastic or thermoset dissolved or dispersed in an industrially acceptable solvent. The thermoset shell will be selected from a group consisting of but not limited to phenolics, epoxies, alkyds, polyesters or silicones.

The inorganic shell will be selected from a group consisting of but not limited to silicates, metal oxides, ceramics, borides, nitrides, carbides, ferrites or phosphates. In this regard, the thermoplastic-solvent solution is sprayed into a fluidized bed of airborne particles circulating in a suitable coating apparatus. Suitable apparatus for conducting such fluidized bed coating are well known in the art and, for example, are disclosed in such patents as Smith-Johannson U.S. Pat. No. 3,992,558, Lindlof et al U.S. Pat. No. 3,117,027, Reynolds U.S. Pat. No. 3,354,863, Wurster U.S. Pat. No. 2,648, 609, and Wurster U.S. Pat. No. 3,253,944.

The inorganic shell can be deposited by several processes such as a slurry coating process, oxidation, chemical exchange reaction, reduction, or pressure vapor deposition.

A combination of materials and processes may be used to comprise the shell. An inorganic layer may be deposited first followed by a coated layer of a thermoplastic or thermoset material.

While the separation of the compacted core from the copper tube normally does not require any separation materials, it has been found desirable for improved efficiency to utilize separation aids. These aids can be oil remaining within the copper tube after its manufacture, or the application of some additional material to the copper surface itself. This can take the form of biodegradable materials such as vegetable oil, or normal silicone containing materials that are surfactants and the like. Well known commercially available materials may be utilized.

Listed below are description of preferred embodiments wherein all parts are parts by weight and all degrees are degrees centigrade.

EXAMPLES

DESCRIPTION OF PROCESS TO MANUFACTURE CORE

The copper sleeve had an approximate outside diameter of 19 mm, a wall thickness of 1 m and a length of 50 mm. The alloy type of copper sleeve was C12200 phosphorous—deoxidized copper, high residual phosphorous. However, other materials may be used such as aluminum, steel and other grades of copper. Thickness of the sleeve depends primarily on the electrical conductivity of the material.

The iron particles, having a size varying from about 100 microns to 400 microns in diameter and have a polymer coating such as Ultem or Teflon to a percentage by weight of 0.05% to 1.25% total, including the iron weight. The actual polymer or resin can vary.

The powder typically can achieve higher density if preheated to a temperature from 70° C. to 300° C. depending on the polymer used on the powder.

The heated or room temperature powder is then metered with an accuracy of +1.5% by weight into the copper tube described above. The excess powder is struck off with a wiper. An end cap is then pressed onto the top of the copper tube, thus trapping the powder into the container.

The package of two (2) end caps and the copper tube with powder are then positioned inside a large one-turn coil (see FIG. 2). Energy of 150 to 250 Kilo-Joules is then released into the coil. This energy develops a counter magnetic field that applies pressure into the copper and powder, densifying the powder to 99% of theoretical density.

DEMONSTRATED IMPROVED PERFORMANCE

Figure 4:
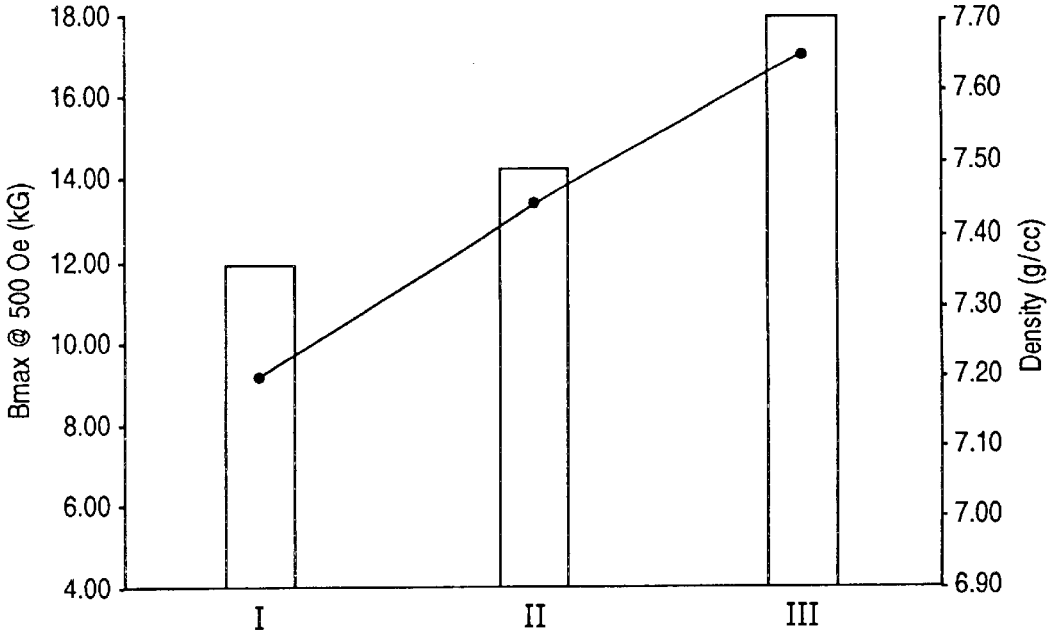
FIG. 4 is a graph of the density (g/cc) of compacted material v. Bmax at 500 Oe for current commercial production material, high performance powder compacted material prepared according to U.S. Pat. No. 5,629,092 and the material produced according to the present process as shown in the example.

Magnetic tests have been completed which demonstrate the improved magnetic performance of magnetic compaction. (See FIG. 4)

The first bar demonstrates performance of current production material (I) using mechanical compaction. The second bar (II) demonstrates using a material prepared according to U.S. Pat. No. 5,629,092 which uses mechanical compaction. The third bar (III) demonstrates the performance of iron powder coated with 0.15% wt. Ultem, 0.1% acrylic, and 0.1% Teflon on 1000 C Hoeganaes powder using magnetic compaction of the present invention. Note the higher density and higher flux carrying capacity.

Figure 5:
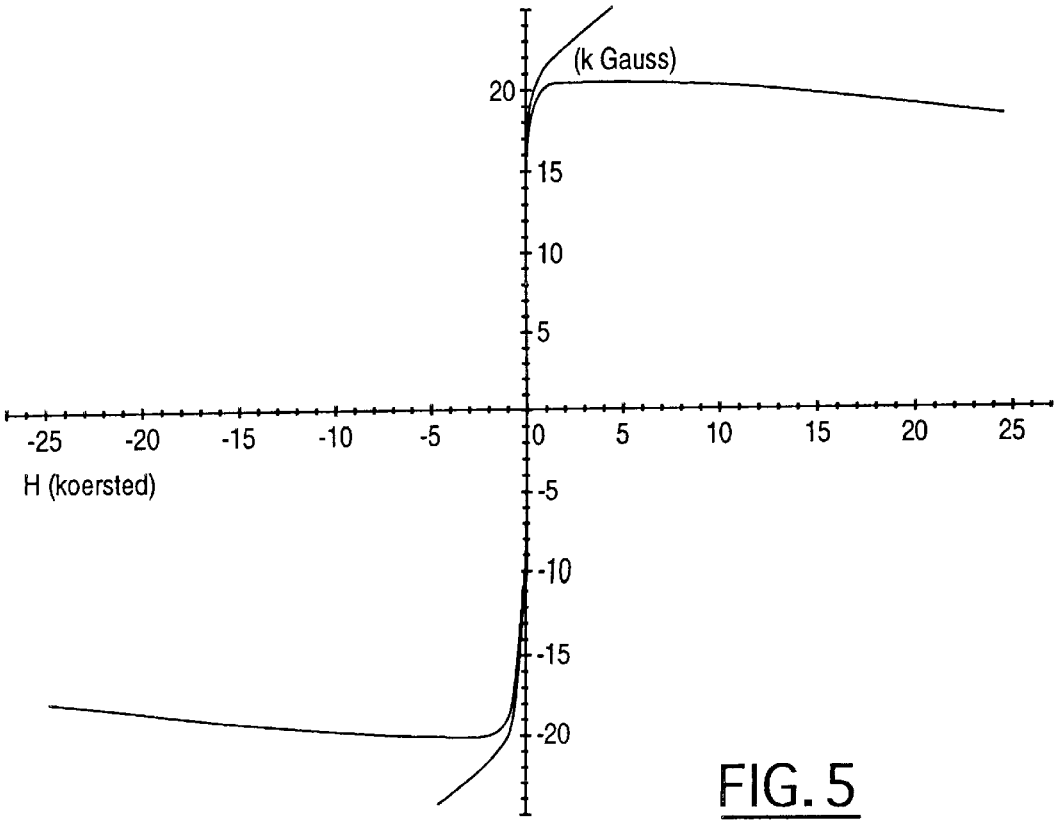
FIG. 5 is a B–H curve at high Oersted (Oe) levels. This curve shows the flux density "B" (gauss) that can be produced in the core by a given magnetizing force "H". The higher the "B" for a given "H" the greater the performance of the core.

FIG. 5 demonstrates a B–H curve at high Oerstead levels. (Note 20 Kg or 2.0 tesla at 2500 Oe.)

The table below is a summary of tests performed by the Zener Technique (Society of Automotive Engineers SAE J 973) comparing the three (3) groups of samples. The first two (2) groups (SC40 and HP) were die pressed parts and the third group were cores manufactured from the present process. Note the average energy load-showing present process as having the highest energy available for a spark plug.

COIL PERFORMANCE (SAE J 973)
Composite Iron Core Study
HP vs SC40 vs Invention — 9 Amps

| Material | | S/N | Zener Load (V) | B+ Voltage (V) | Pri. Rise Time (mS) | Pri. Res. (Ohms) | Sec. Resis (Ohms) | Sec. Ext. Res. (Kohms) | Input Energy (mJ) | Primary Res. Loss (mJ) |
|---|---|---|---|---|---|---|---|---|---|---|
| SC40 | Average | 0 | 800 | 0.0 | 2.27 | 0.4663 | 0 | 0 | 150.1 | 30.5 |
| 9 Amps. | Max. | 0 | 800 | 0.0 | 2.33 | 0.4678 | 0 | 0 | 154.8 | 32.0 |
| 13 pcs* | Min. | 0 | 800 | 0.0 | 2.22 | 0.4642 | 0 | 0 | 147.2 | 29.7 |
| HP | Average | 0 | 800 | 0.0 | 2.52 | 0.4648 | 0 | 0 | 165.2 | 32.6 |
| 9 Amps | Max. | 0 | 800 | 0.0 | 2.56 | 0.4666 | 0 | 0 | 168.4 | 33.2 |
| 12 pcs | Min. | 0 | 800 | 0.0 | 2.44 | 0.4631 | 0 | 0 | 160.9 | 32.1 |
| Invention | Average | 0 | 800 | 0.0 | 2.72 | 0.4636 | 0 | 0 | 177.2 | 34.8 |
| 9 Amps | Max. | 0 | 800 | 0.0 | 2.76 | 0.4644 | 0 | 0 | 178.3 | 35.1 |
| 5 pcs | Min. | 0 | 800 | 0.0 | 2.68 | 0.4833 | 0 | 0 | 176.6 | 34.5 |

| Material | Primary Cond. Loss (mJ) | Primary Leak. Loss (mJ) | Core Loss (mJ) | Secondary Res. Loss (mJ) | Secondary Ext. Loss (mJ) | Energy Load (mJ) | Peak Isac. Load Max. (mA) | Burn Time Load (mS) |
|---|---|---|---|---|---|---|---|---|
| SC40 | 18.1 | 6.7 | 20.6 | 12.9 | 18.5 | 42.7 | 103.3 | 1.28 |
| 9 Amps. | 19.5 | 6.8 | 21.9 | 13.2 | 18.9 | 43.5 | 106.3 | 1.30 |
| 13 pcs* | 17.8 | 6.5 | 19.9 | 12.6 | 18.2 | 42.0 | 100.2 | 1.25 |
| HP | 20.0 | 6.8 | 23.8 | 14.2 | 20.5 | 47.3 | 103.9 | 1.43 |
| 9 Amps | 20.3 | 6.9 | 25.6 | 14.4 | 20.7 | 48.0 | 105.8 | 1.45 |
| 12 pcs | 19.6 | 6.7 | 21.8 | 14.0 | 20.2 | 46.2 | 102.5 | 1.38 |
| Invention | 21.4 | 6.6 | 26.0 | 15.4 | 22.1 | 50.9 | 105.1 | 1.54 |
| 9 Amps | 21.5 | 6.6 | 26.6 | 15.4 | 22.2 | 51.2 | 106.7 | 1.56 |
| 5 pcs | 21.3 | 6.0 | 25.4 | 15.3 | 22.0 | 50.4 | 102.9 | 1.52 |

*pcs = number of cores tested.

While the forms of the invention herein disclosed constitute presently preferred embodiments, many others are possible. It is not intended herein to mention all of the possible equivalent forms or ramifications of the invention. It is understood that the terms used herein are merely descriptive, rather than limiting, and that various changes may be made without departing from the spirit or scope of the invention.

What is claimed is:

1. A process for producing an AC cylindrical electromagnetic part comprising:

filling a cylindrical holding container with powdered metal comprised fo ferromagnetic particles;

placing the filled container into an electromagnetic field and compacting, in the radial direction, the powder in the container by subjecting the powder to the electromagnetic field; and recovering the compacted AC electromagnetic part.

2. A process for producing an AC cylindrical electromagnetic ignition coil core comprising:

filling a cylindrical holding container with powdered metal comprised of ferromagnetic particles;

placing the filled container into an electromagnetic field and compacting, in the radial direction, the powder in the container by subjecting the powder to the electromagnetic field; and recovering the compacted ignition coil core.

3. The process of claim 1 wherein the part produced has at least 96% of theoretical density of the metal.

4. The process of claim 1 wherein the part produced is an ignition coil and it has a resistivity ranging from about 0.0004 to about 4.8 ohm•cm.

5. The process of claim 1 wherein the metal particle size, prior to compaction, ranges from about 5 to about 400 micrometers.

6. An improved electromagnetic part comprising a compacted powdered metal part comprised of ferromagnetic particles which has been compacted in the radial direction by being subjected to an electromagnetic field wherein the part has at least 96% of theoretical density of the metal.

7. The process of claim 1 wherein the filled container is subjected to the electromagnetic field for less than 1 second.

8. The process of claim 2 wherein the filled container is subjected to the electromagnetic field for less than 1 second.

9. The process of claim 1 wherein the filled container is subjected to the electromagnetic field for less than 80 microseconds.

10. The part of claim 6 wherein the part is an ignition coil core and it has a resistivity ranging from about 0.0004 to about 4.8 ohm•ocm.

11. The part of claim 6 wherein the initial particle size prior to compaction ranges from about 5 to about 400 micrometers.

12. The process of claim 1 wherein the particles are selected from the group consisting of iron and alloys of iron which alloy contains any one of copper, nickel, zinc, cobalt, silicone or manganese.

13. The process of claim 2 wherein the particles are selected from the group consisting of iron and alloys of iron which alloy contains any one of copper, nickel, zinc, cobalt, silicone or manganese.

14. The part of claim 6 wherein the metal particles are selected from the group consisting of iron and alloys of iron which alloy contains any one of copper, nickel, zinc, cobalt, silicone or manganese.

* * * * *